United States Patent [19]

Stallings et al.

[11] Patent Number: 4,494,043

[45] Date of Patent: Jan. 15, 1985

[54] IMPLODING PLASMA DEVICE

[75] Inventors: Charles H. Stallings, Pleasanton; Richard L. Schneider, Hayward, both of Calif.; Frederick K. Childers, Winchester, Mass.; Stephen M. Matthews, Oakland, Calif.; Ian S. Roth, Ithaca, N.Y.; Heikki I. Helava; Ray M. Stringfield, Jr., both of Oakland, Calif.

[73] Assignee: Physics International Company, San Leandro, Calif.

[21] Appl. No.: 280,066

[22] Filed: Jul. 2, 1981

[51] Int. Cl.[3] ..... H01J 7/24

[52] U.S. Cl. ..... 315/111.41; 376/143; 376/144

[58] Field of Search ..... 376/143, 144; 315/276, 315/111.21, 111.41

[56] References Cited

U.S. PATENT DOCUMENTS

| | | | |
|---|---|---|---|
| 3,052,614 | 9/1962 | Herold | 376/143 |
| 3,105,027 | 9/1963 | Carruthers et al. | 376/143 |
| 3,569,777 | 3/1971 | Beaudry | 315/276 |
| 3,624,240 | 3/1970 | Damm et al. | 376/143 |
| 3,733,248 | 5/1973 | Hendel et al. | 376/143 |
| 3,959,710 | 5/1976 | Hill, Jr. | 376/143 |
| 4,184,078 | 1/1980 | Nagel et al. | 250/492 A |
| 4,284,489 | 8/1981 | Weber | 315/276 |

OTHER PUBLICATIONS

Nuclear Fusion 18 6(1978), p. 813, "The Formation of High-Density Z-Pinches", D. Potter, Blackett Laboratories, London.

J. Appl. Phys. 49(9), Sep. 1978, "Electromagnetic-Implosion Generator or High-Energy-Density Plasma", W. L. Baker et al.

Applied Physics Letters, vol. 29, No. 7, Oct. 1, 1976, "Multiple-Wire Array Load for High-Power Pulsed Generators", Stallings et al., (I).

"High Density Z-Pinch", Amnon Fisher and Joseph Shaloh, Physics Depart., Univ. of Calif., Irvine, CA., Paper.

Appl. Physics Lett. 35(7), Oct. 1, 1979, "Imploding Argon Plasma Experiments", C. Stallings et al., (II).

"Further Argon Experiments on the Pithon Reb Generator", R. Schneider et al., Physics International Report PIIR-13-80, Sep. '80.

*Primary Examiner*—Sal Cangialosi

*Attorney, Agent, or Firm*—Robert R. Tipton

[57] ABSTRACT

An ionizable material is ejected in the shape of a cylindrical column from a cathode-nozzle toward an anode and subjected to a very short, high voltage pulse of electrical current having sufficient magnitude to create a high magnetic field which implodes the cylindrical column of ionizable material to a very high density plasma that emits long wave length x-rays. Accurate and reliably reproduced x-ray bursts are provided through coupling of the cathode and anode to the high voltage pulse generator without substantially degrading the pulse. The conductors between the pulse generator and the cathode and anode are of a configuration whereby a magnetic field is used to prevent the electron losses by tapering the spacing between feed conductors and shaping the feed conductors so that space-charge flow is retrapped and made usable.

5 Claims, 4 Drawing Figures

IMPLODING PLASMA DEVICE

NOTICE OF GOVERNMENT INTEREST

The United States Government has rights in this invention pursuant to Contract No. F29601-78-C-0091 awarded by the Department of Defense, Air Force Contract Management Division, Kirtland A.F.B., New Mexico.

BACKGROUND OF THE PRIOR ART

This invention relates generally to imploding plasma devices and in particular to methods and apparatus for imploding a plasma to achieve a consistent and reliable source of low frequency X-rays.

Imploding plasma devices are known in which a stream or column of ionizable material is subjected to a sudden pulse of high voltage current causing it to ionize and collapse or implode to create a very high density plasma capable of emitting long wave length X-rays. These devices have electrical pulses somewhat greater than 1 microsecond.

Such devices, however, although producing X-rays, show wide variation in X-ray radiation from consecutive pulses. These radical variations in X-ray output can be caused by a number of factors including inaccurate metering of the ionizable material into the space between the anode and cathode, improper shaping of the ionizable material column between the anode and the cathode, failure to properly shape the pulse of electrical current generated by the high voltage, high current pulse generating apparatus, failure to properly couple the anode and cathode to the high voltage pulse generator resulting in electron losses, and failure to properly shape the electrodes, in particular, the cathode at the termination of the feed conductors at the cathode-nozzle.

SUMMARY OF THE INVENTION

To overcome these prior art difficulties and create a reliable and consistently reproducible burst of soft X-rays, the imploding plasma device of the present invention comprises an anode, a cathode-nozzle spaced apart from the anode, the cathode comprising a nozzle adapted to inject an ionizable material into the gap or space between the anode and the cathode in the shape of a cylindrical column at which instant a high current pulse from a high voltage pulse generator is passed through the cylindrical column of ionizable material causing it to collapse or implode and generate a sudden burst of soft X-rays. The pulse from the generator is about 0.1 microseconds. The anode and cathode are coupled to the high voltage generator whereby the impedance between the anode and cathode and the high voltage generator is not substantially degraded. The apparatus utilizes a self-magnetic field about the cathode and anode feed conductors which causes electrons emitted from the feed conductors to be deflected back into the conductor. The conductors define generally radially planar surfaces for transporting the pulse from the large diameter generator output to a small diameter plasma load, and are spaced apart with the spacing greatest at the outside diameters and least at the inside diameter. The cathode-nozzle and anode conductor adjacent the cathode-nozzle are shaped to define a cylinder so that the space-charge flow in the magnetically insulated cathode and anode feed conductors is retrapped and made usable.

A pulse-operated magnetic valve is used to create the desired gas profile and density in a 100–1,500 microsecond time period.

The ionizable material can be pre-ionized by microwave or ultraviolet radiation or other techniques, to establish the initial current flow pattern for the electrical pulse.

The cathode-nozzle is arranged to provide supersonic flow of the ionizable material in a shape and direction to provide for stable compressions.

It is, therefore, an object of the present invention to provide an apparatus for imploding plasmas of repeatable density and emission of radiation.

It is a further object of the present invention to provide an imploding plasma device having a low inductance power feed to the cathode-anode configuration.

It is another object of the present invention to provide an imploding plasma device in which the ionizable material defines a generally hollow cylindrical column or cylindrical shell.

It is yet another object of the present invention to provide an imploding plasma device utilizing a pulse operated magnetic valve.

It is still a further object of the present invention to provide an imploding plasma device in which the feed conductors utilize the principle of magnetic insulation.

It is yet a further object of the present invention to provide an imploding plasma device in which the feed conductors define generally radially planar members having an inner and an outer diameter.

It is still an additional object of the present invention to provide an imploding plasma device in which the planar conductors are spaced apart and taper toward each other as they approach the cathode anode configuration.

It is still a further object of the present invention to provide an imploding plasma device in which the cathode is shaped so that space-charge flow in the magnetically insulated conductors is retrapped and made usable.

It is yet another object of the present invention to provide an imploding plasma device utilizing a cathode nozzle to provide supersonic flow of the ionizable material in a hollow cylindrical column and with sufficient control to provide for stable compressions.

It is yet an additional object of the present invention to provide an imploding plasma device in which the ionizable material is pre-ionized prior to subjecting it to a high current pulse of electrical energy.

These and other objects of the present invention will become manifest upon study of the following detailed description when taken together with the drawings.

DESCRIPTION OF THE PREFERRED EMBODIMENT

Figure 1:
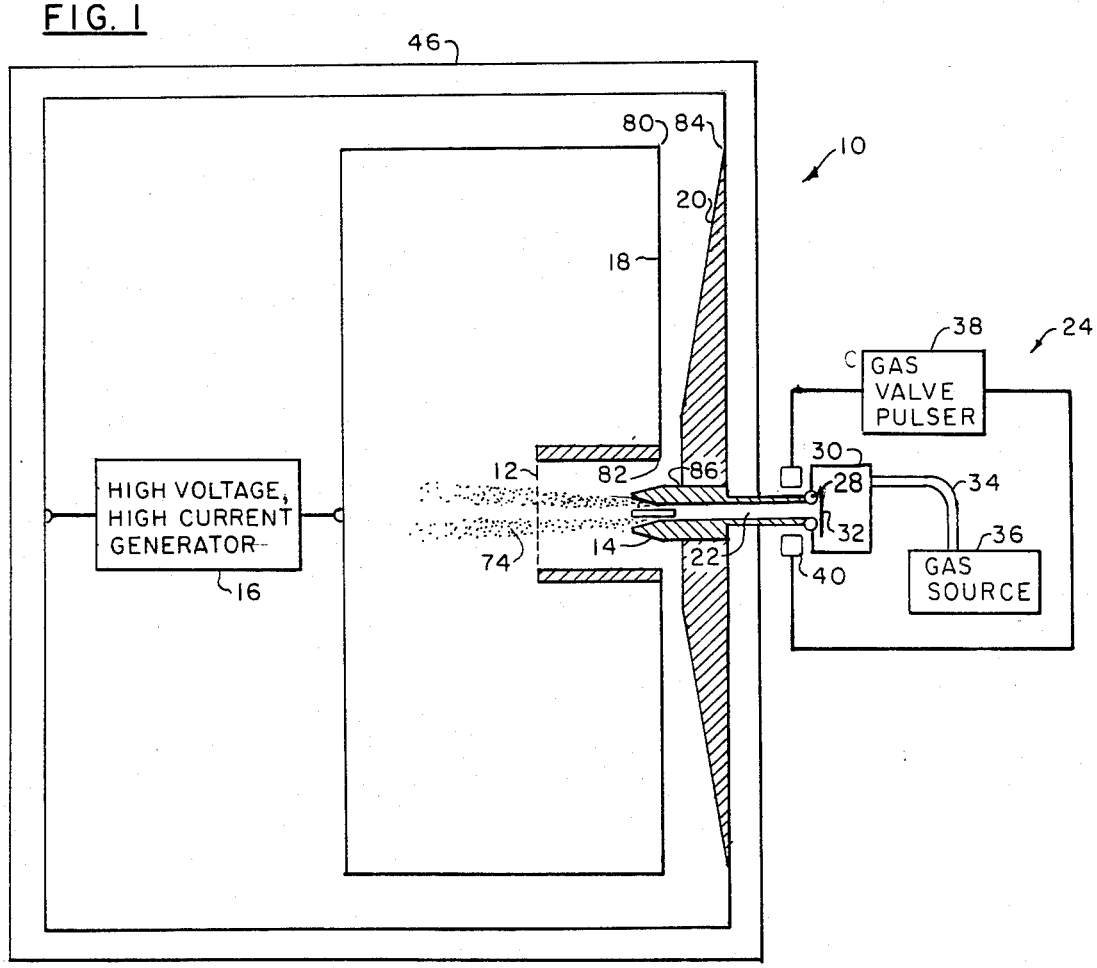
FIG. 1 is a schematic diagram showing the basic configuration of the cathode-anode feed conductor arrangement and gas valve combination of the present invention.

With reference to FIG. 1 there is illustrated a schematic diagram of the imploding plasma device 10 of the present invention comprising, basically, a foraminous anode 12 spaced apart from a cathode-nozzle 14, which anode 12 and cathode 14 are electrically connected, respectively, to high voltage, high current generator 16 through anode feed conductor 18 and cathode feed conductor 20.

A conduit 22 connects cathode-nozzle 14 to gas pulse shaper apparatus 24.

Gas pulse shaper apparatus 24 comprises, basically, gas valve 30 having an aluminum valve member 32 disposed over the end of conduit 22 defining a valve seat 28 with a conduit 34 connecting gas valve 30 to gas source 36.

Gas valve pulser 38 is connected to magnetic coil or solenoid 40 juxtaposed adjacent aluminum valve member 32 so that aluminum valve member 32 comes within the magnetic field created by magnetic coil or solenoid 40. A vacuum-tight housing 46 is provided around the cathode-anode configuration and their conductors.

Figure 2:
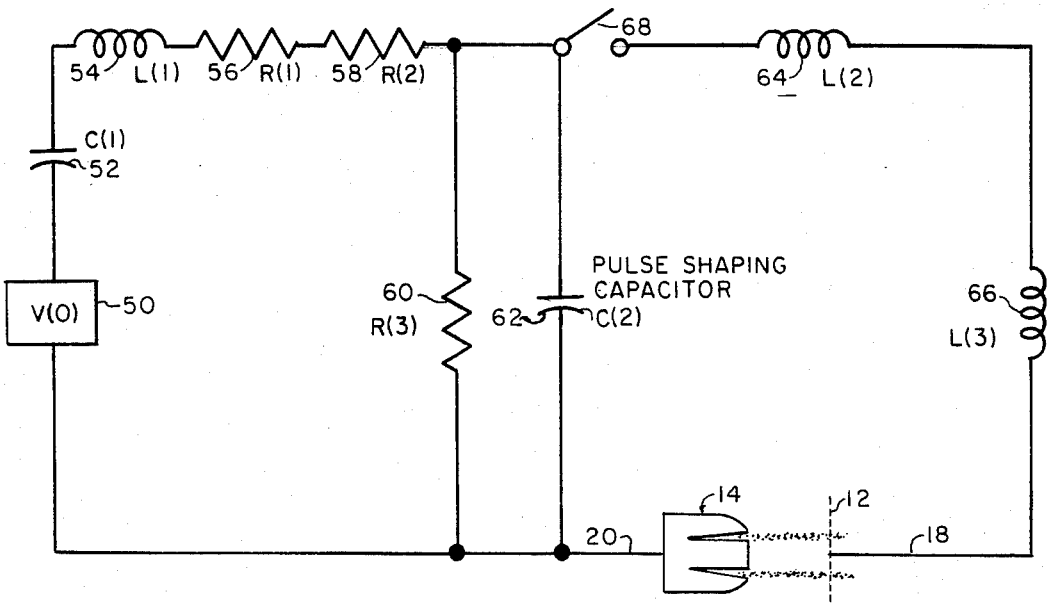
FIG. 2 is a schematic electrical circuit diagram of the apparatus of FIG. 1 showing some of the basic capacitances, inductances and resistances in the circuit and their method of connection.

With reference to FIG. 2 there is illustrated a schematic electrical diagram of the high volatage, high current generator 16 and cathode 14, anode 12, cathode feed conductor 20 and anode feed conductor 18 configuration of FIG. 1.

Typically, high voltage, high current generator 16 would comprise a Marx Generator, well known in the art, in which a voltage source V(0) 50 is supplied as an initial charge to the circuit comprising Marx capacitor C(1) 52, first inductance L(1) 54, in series with first resistance R(1) 56, the above being the internal capacitances, resistances and inductances of the Marx generator.

A pulse-shaping capacitor C(2) 62 is connected across the output of the Marx generator circuit previously described, through a series of resistance R(2) 58. This capacitor has an internal resistance R(3) 60.

A second inductance L(2) 64 representing the inductance of feed conductors 18 and 20 is connected in series with anode 12 and cathode-nozzle 14, which have an internal inductance L(3) 66.

A switch 68 connects the Marx generator portion of the circuit to the anode 12-cathode 14, anode feed conductor 18-cathode feed conductor 20 configuration.

The operation of the simplified version of the plasma imploding device 10 of the present invention illustrated in FIGS. 1 and 2 is as follows:

Housing 46 is evacuated to a high vacuum, generally to a pressure of a few times $10^{-4}$ torr. An ionizable material, such as a gas or gas-powder mixture, is allowed to flow from gas source 36 through conduit 34 into gas valve 30.

Gas valve pulser 38 is actuated to generate a pulse to create a high magnetic field using magnetic coil or solenoid 40. The magnetic field causes eddy current to flow within aluminum valve member 32 sufficient to cause valve member 32 to be repelled away from valve seat 28, allowing a brief, 100–1,500 microsecond puff of gas to flow down conduit 22 through cathode-nozzle 14 and out towards foraminous anode 12 defining a cylindrical column 74 shown in section in FIG. 1. Concurrently with the injection of the gas through anode 12, switch 68 of high voltage, high current generator 16 is closed causing a high voltage, high electron current pulse to be conducted toward cathode 14 through cathode feed conductor 20, through cathode 14 and back through anode 12 and anode feed conductor 18.

It will be noted that anode feed conductor 18 and cathode feed conductor 20 define a generally radially planar surface having an outside diameter radially greater than an inside diameter. In particular, anode feed conductor 18 would have an outside diameter terminating at point 80 and an inside diameter terminating at point 82, while cathode feed conductor 20 would have an outside diameter terminating at point 84 and an inside diameter terminating at point 86.

It will be further noted that the spacing between anode feed conductor 18 and cathode feed conductor 20 is greater at their outside diameters at points 80 and 84 and narrower as they approach their inner diameters at points 82 and 86. The flow of current, therefore, is radial from point 84 to point 86 which tends to create a magnetic field of sufficient magnitude and direction whereby any electrons emitted from cathode feed conductor 20 are caused to turn back into the conductor. In other words, the self-magnetic field pinches off most electron losses. In effect, a magnetic insulation of the conductors is achieved.

Typically, the spacing between anode feed conductor 18 and cathode feed conductor 20 will vary from about 5 mm down to 1 mm, minimum, for generators whose output currents vary from 100 kiloamps to the multi-mega-amp range. In this manner, the principle of magnetic insulation is used to prevent losses of electrons and degrading of the inductance between the high voltage, high current generator 16 and cathode 14-anode 12 configuration.

Upon closure of switch 68, the high voltage, high electron current pulse will travel down cathode feed conductor 20 causing an electrical current to flow through cylindrical shell or hollow cylindrical column of ionizable material 74. Such a high current will cause a rapid implosion of cylindrical column 74 thereby producing a very high density, high temperature plasma capable of generating low frequency X-rays.

Because of the accurate control of the impedance of the feed conductors to the anode-cathode configuration, along with the ability of the gas valve pulser 38 to shape the gas pulse being emitted from cathode-nozzle 14, consistent and reliable implosion results can be achieved.

Figure 3:
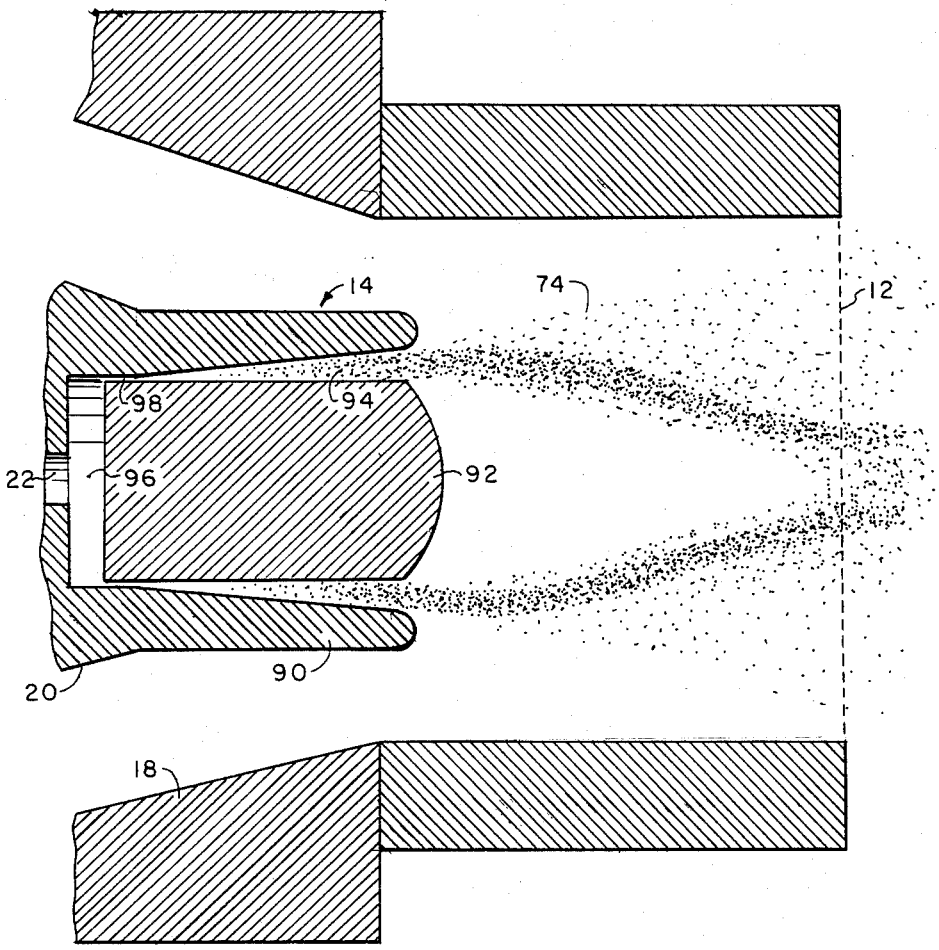
FIG. 3 is a cross-sectional, elevational view of a typical cathode-nozzle and anode configuration showing the flow densities of the ionizable material immediately after injection of the material into the space between the anode and cathode and at the moment of application of the high voltage, high current pulse.

With reference to FIG. 3, there is illustrated a typical supersonic cathode-nozzle 14 and foraminous anode 12 configuration showing the typical shape of ionizable material flowing between anode 12 and cathode 14.

Typically, cathode-nozzle 14 comprises an outer peripheral lip 90 defining a generally cylindrical member spaced apart and concentric about central cylindrical plug member 92 to thereby define a generally tapered throat 94.

A gas stilling chamber 96 is provided at the base of cylindrical plug member 92 which receives gas from gas feed conduit 22. The ionizable gas entering from feed conduit 22 into stilling chamber 96 passes through constricted portion 98 and then into annular tapered throat 94 to be ejected at very high velocity into the shape between cathode-nozzle 14 and foraminous anode 12.

Ionizable material 74 is shown as a dotted cloud with the cross-sectional density illustrated by a darkening or closer spacing of the particles of the ionizable material 74.

It can be seen that the ejected ionizable material will define a cylindrical shell immediately upon leaving cathode-nozzle 14 and when subjected to the high current pulse from high voltage, high current generator 16, it will be caused to pinch or be compressed into a high density plasma and thereby emit soft X-ray as though from a point source.

Figure 4:
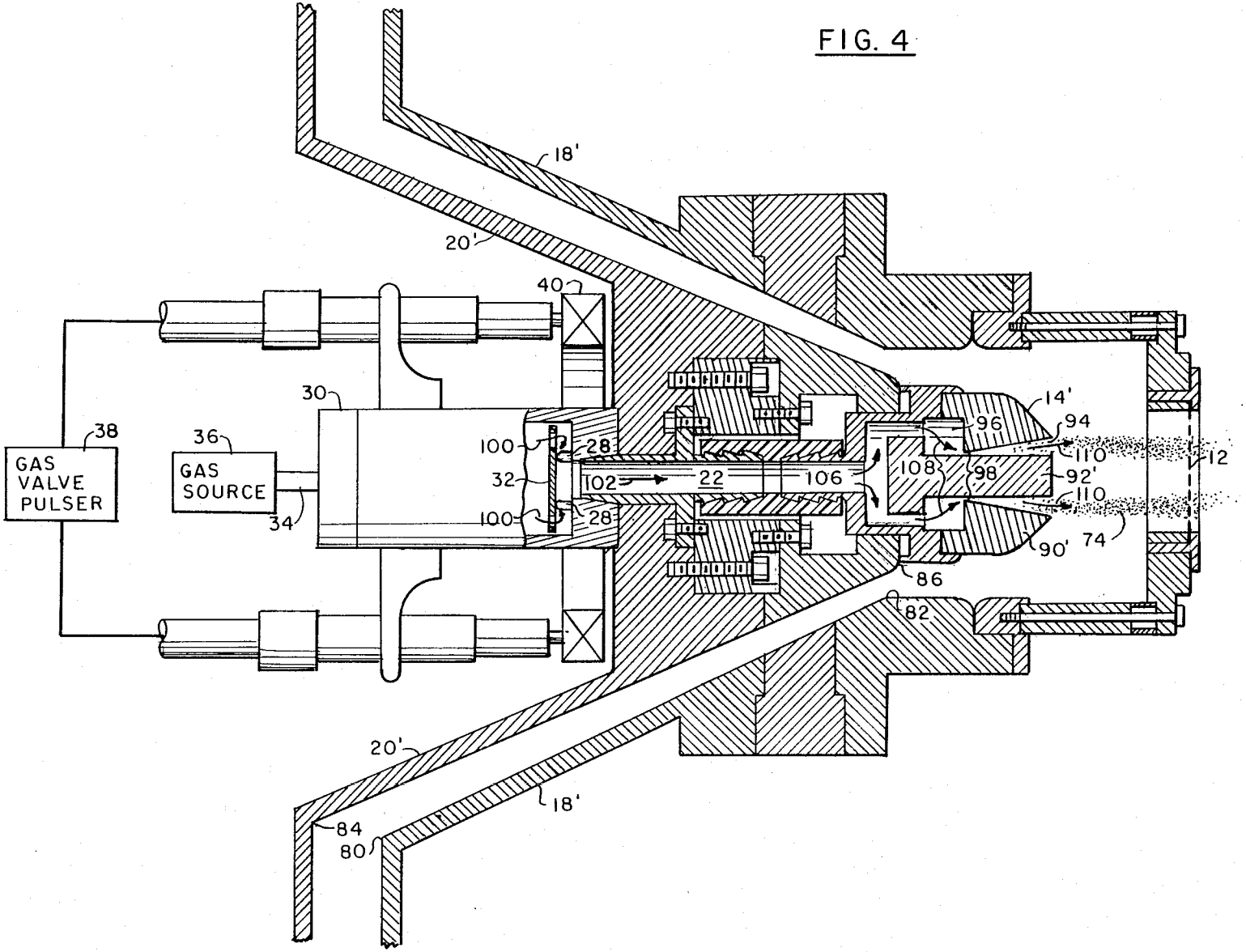
FIG. 4 is a cross-sectional, elevational view of an actual device used for imploding a cylindrical column of ionizable material.

With reference to FIG. 4, there is illustrated a cross-sectional, elevational view of an actual apparatus constructed to implode an ionizable material.

The apparatus of FIG. 4 comprises, basically, the same elements as identified in FIG. 1, however, anode feed conductor 18' and cathode feed conductor 20', instead of being perpendicular to the direction of ejection of ionizable material, are adapted to be conical in shape, however, still being spaced apart from each other but tapering from a maximum spacing at outer diameter 80 of anode feed conductor 18' and outer diameter 84 of cathode feed conductor 20' to a narrowest point at inside diameter 82 of anode feed conductor 18' and inner diameter 84 of cathode feed conductor 20'. The narrowest point between inner diameters 82 and 86 are established to be at the rear of cathode-nozzle 14' in order to cause space-charge flow electrons to reenter nozzle 14' and achieve maximum flow of electrons through ionizable material cylindrical column 74.

In FIG. 4 (as also shown in FIG. 1) cathode-nozzle 14' (14) projects toward anode 12' (12) creating a cylindrically spaced apart configuration between cathode 14' (14) and the feed conductor portion of feed conductor 18' (18) between point 82 and anode 12' (12).

Still with reference to FIG. 4, to operate the imploding plasma device as shown in FIG. 4, gas valve pulser 38 is caused to generate a current and activate magnetic coil or solenoid 40 to generate a magnetic field to cause eddy currents to flow in aluminum valve member 32. As eddy currents are formed in aluminum valve member 32, valve member 32 will be repelled by the magnetic field generated by magnetic coil or solenoid 40 away from valve seat 28. This action will cause gas to flow from gas source 36 through conduit 34 into gas valve 30 and then out between aluminum valve member 32 and valve seat 28, as shown by arrow 100. The gas then flows into gas feed conduit 22, as shown by arrow 102, and from there to flow to stilling chamber 96, as shown by arrows 106. The gas then flows out through constricted portion 98 into nozzle throat 94, as shown by arrows 108 and 110, and finally out into the space between cathode 14' and foraminous anode 12'. Because of the annular shape of nozzle throat 94, the gas is ejected to define a cylindrical shell 74 of ionizable material. While the gas still defines a cylindrical column, a high voltage, high current pulse is applied by high voltage, high current generator 16 to anode feed conductors 18' and cathode feed conductor 20'. This current causes a high magnetic field to be created between those conductors causing any electrons emitted by the cathode feed conductor to be returned into cathode feed conductor 20' thus maintaining the high impedance between conductors. Because the point of narrowest feed conductor spacing is proximate the back of cathode-nozzle 14, any space charge electrons emitted by cathode feed conductor 20 will be redirected into cathode-nozzle 14'. Thus, a high flow of current will be caused to pass through cylindrical column 74 of ionizable material thereby creating a high pinch effect to condense and pinch now ionized material into a high density plasma to generate soft X-rays.

Typically, the collapsed pinch will occur in the pulse at about 100 nanoseconds, and produce an X-ray pulse 20–30 nanoseconds long.

Typical values of capacitance, resistance and inductance for the Marx generator and feed conductors, of the type shown in FIG. 2, is listed in Table 1.

TABLE 1

Typical Values of Electrical Elements

| Element Number | Element Designation | Value |
|---|---|---|
| 52 | C(1) | 376 nF |
| 54 | L(2) | 22 nH |
| 56 | R(1) | 0.016 Ohms |
| 58 | R(2) | 1.85 Ohms |
| 60 | R(3) | 190 Ohms |
| 62 | C(2) | 100 nF (Peaking Cap.) |
| 64 | L(2) | 5 nH |
| 66 | L(3) | 7 nH |

V(0) = 200 Kilovolts initial Charge Switch 68 closes after 60 nanoseconds

In some instances, the ionizable material being injected into the space between cathode-nozzle 14 and foraminous anode 12 can be pre-ionized. Such methods can include subjecting the material to microwave radiation, ultraviolet radiation or including in the ionizable material organic compounds that release electrons such as tripropylamine or trimethalamine.

Thus is described a device for imploding a plasma.

We claim:

1. An imploding plasma device comprising an ionizable material, an anode, a cathode spaced apart from said anode comprising a nozzle adapted to inject said ionizable material toward said anode, said injected ionizable material defining a hollow cylindrical column, means for generating a high voltage pulse of electrical current, means for connecting said means for generating a high voltage pulse of electrical current to said anode and said cathode comprising a cathode feed conductor having one end electrically connected to one side of said means for generating a high voltage pulse and the other end electrically connected to said cathode, an anode feed conductor having one end electrically connected to the other side of said means for generating a high voltage pulse and the other end electrically connected to said anode, said cathode feed conductor spaced apart from said anode feed conductor, said spacing being tapered toward each other as they approach said anode and said cathode, and means for creating a magnetic field between said cathode feed conductor and said anode feed conductor in a direction to cause electrons emitted from said cathode feed conductor to be deflected back to said cathode feed conductor.

2. An imploding plasma device comprising an ionizable material, an anode, a cathode spaced apart from said anode comprising a nozzle adapted to inject said ionizable material toward said anode, said injected ionizable material defining a hollow cylindrical column, means for generating a high voltage pulse of electrical current, means for connecting said means for generating a high voltage pulse of electrical current to said anode and said cathode comprising a cathode feed conductor having one end connected to said cathode and the other end connected to one side of said means for generating a high voltage pulse of electrical current, said cathode feed conductor comprising a generally radially planar first conductor having an outer diameter connected to one side of said means for generating a high voltage pulse and an inner diameter connected to said cathode, an anode feed conductor having one end connected to said anode and the other end connected to the other side of said means for generating a high voltage pulse of electrical current said anode feed conductor comprising a generally radially planar second conductor having an outer diameter connected to the other side of said means for generating a high voltage pulse of electrical current and an inner diameter connected to said anode, said generally radially planar first conductor being spaced apart from said generally radially planar second conductor.

3. The imploding plasma device as claimed in claim 2 wherein the spacing between said first and said second planar conductors is greater proximate said outer diameters of said first and second conductors than the spacing between said first and second conductors proximate said inner diameters of said first and second conductors.

4. The imploding plasma device as claimed in claim 3 wherein said spacing between said first and second conductors becomes narrow proximate said cathode.

5. The imploding plasma device as claimed in claim 3 wherein said spacing between said first and second conductors is narrowest at a point back from the end of said nozzle, the spacing between said nozzle and said second conductor being generally cylindrical.

* * * * *